US005125202A

United States Patent [19]

Kissinger

[11] Patent Number: 5,125,202

[45] Date of Patent: Jun. 30, 1992

[54] PRIVACY PANEL FOR USE WITH OPEN OFFICE FURNITURE SYSTEMS

[76] Inventor: Terrance G. Kissinger, 2136 Pullman Ave., Belmont, Calif. 94002

[21] Appl. No.: 757,884

[22] Filed: Sep. 11, 1991

Related U.S. Application Data

[63] Continuation-in-part of Ser. No. 619,368, Nov. 28, 1990, abandoned.

[51] Int. Cl.[5] ..... E04B 2/00

[52] U.S. Cl. ..... 52/239; 49/372; 49/404; 52/64; 52/67

[58] Field of Search ..... 52/239, 243.1, 67, 49, 52/64, DIG. 7; 49/372, 404; 160/135, 351

[56] References Cited

U.S. PATENT DOCUMENTS

| | | | |
|---|---|---|---|
| 2,904,364 | 9/1959 | Korodi | 52/DIG. 4 |
| 3,400,490 | 9/1968 | Anderson | 49/372 |
| 4,325,204 | 4/1982 | Martine | 49/372 |
| 4,742,645 | 5/1988 | Johnston | 49/372 |

FOREIGN PATENT DOCUMENTS

| | | | |
|---|---|---|---|
| 0789460 | 1/1958 | United Kingdom | 49/372 |

*Primary Examiner*—David A. Scherbel
*Assistant Examiner*—Wynn E. Wood
*Attorney, Agent, or Firm*—Skjerven, Morrill, MacPherson, Franklin & Friel

[57] ABSTRACT

A moveable panel is described for providing privacy for a person in a work station or other location behind an arrangement of one or more stationary panels.

25 Claims, 4 Drawing Sheets

PRIVACY PANEL FOR USE WITH OPEN OFFICE FURNITURE SYSTEMS

This is a continuation-in-part of--application Ser. No. 07/619,368, filed Nov. 28, 1990, now abandoned.

FIELD OF THE INVENTION

This invention relates to modular office systems, and in particular to panels used to provide separate working areas for persons employed in offices, factories and other places of employment.

BACKGROUND OF THE INVENTION

Panels are widely used in commerce and industry to define separate working areas, sometimes referred to as work stations or cubicles, for workers in offices, factories and the like. Such panels have several advantages. They allow for a relatively open workplace, with free distribution of air and light over a large area, thereby avoiding the rigidly compartmentalized environment that would result from a maze of separate rooms and hallways. At the same time, they define a separate working area which each employee can call his or her own, and they provide a modicum of privacy for each employee. Most importantly, panels are relatively inexpensive to install and, being fabricated as separate units, can be readily moved from place to place as the needs of the workplace change. Typically, such panels rest on short legs or glides and range in height from 34 inches to 80 inches, with the most predominant size being approximately 60 inches.

While, as noted, panels provide a certain amount of privacy for each worker, in the past this feature has been limited by the presence of an open entryway into each work station. As a result, each worker is subject to unwanted intrusions and disturbances from other workers and has no way of clearly indicating that he or she does not wish to be disturbed. This has numerous deleterious effects on the quality of work product and environment. For example, a worker may need to concentrate on a particular task in order to complete it on time. Interruptions may break his or her "train of thought" and result in wasted time and stress. Privacy may be desirable during certain meetings or conferences, in particular those relating to performance reviews and other personnel matters. Workers in telemarketing and/or sales need uninterrupted time to communicate with company clients. Health needs may also need to be addressed; workers who are suffering from colds or other ailments may want more privacy for a duration of several days, and this coincides with the interests of other workers in minimizing the risk of contagion.

SUMMARY OF THE INVENTION

In accordance with this invention, a sliding privacy panel is enclosed within a stationary panel on one side of an entryway to a work station. When the privacy panel is not in use, it rests in a cavity inside the stationary panel, the cavity being open on one lateral edge of the stationary panel. When an employee in the work station desires privacy, he or she slides the privacy panel out of the stationary panel to close off the entryway, thereby reducing interference from outside noise and indicating to other workers that he or she does not want to be disturbed. The sliding privacy panel may slide out of the mother panel on ball bearing slides. Magnets may be provided to hold the panel in an open or closed position. A foot containing a roller or skid may be provided to support the privacy panel on the floor when it is in a closed position.

A privacy panel in accordance with this invention is simple and relatively inexpensive.

In another embodiment, the top of the privacy panel slides in a channel mounted in the stationary panel and the bottom of the privacy panel glides on a series of rollers. A V-shaped structure is provided to guide the privacy panel into latching contact with the stationary panel on the opposite side of the entryway.

DETAILED DESCRIPTION OF THE INVENTION

Figure 1:
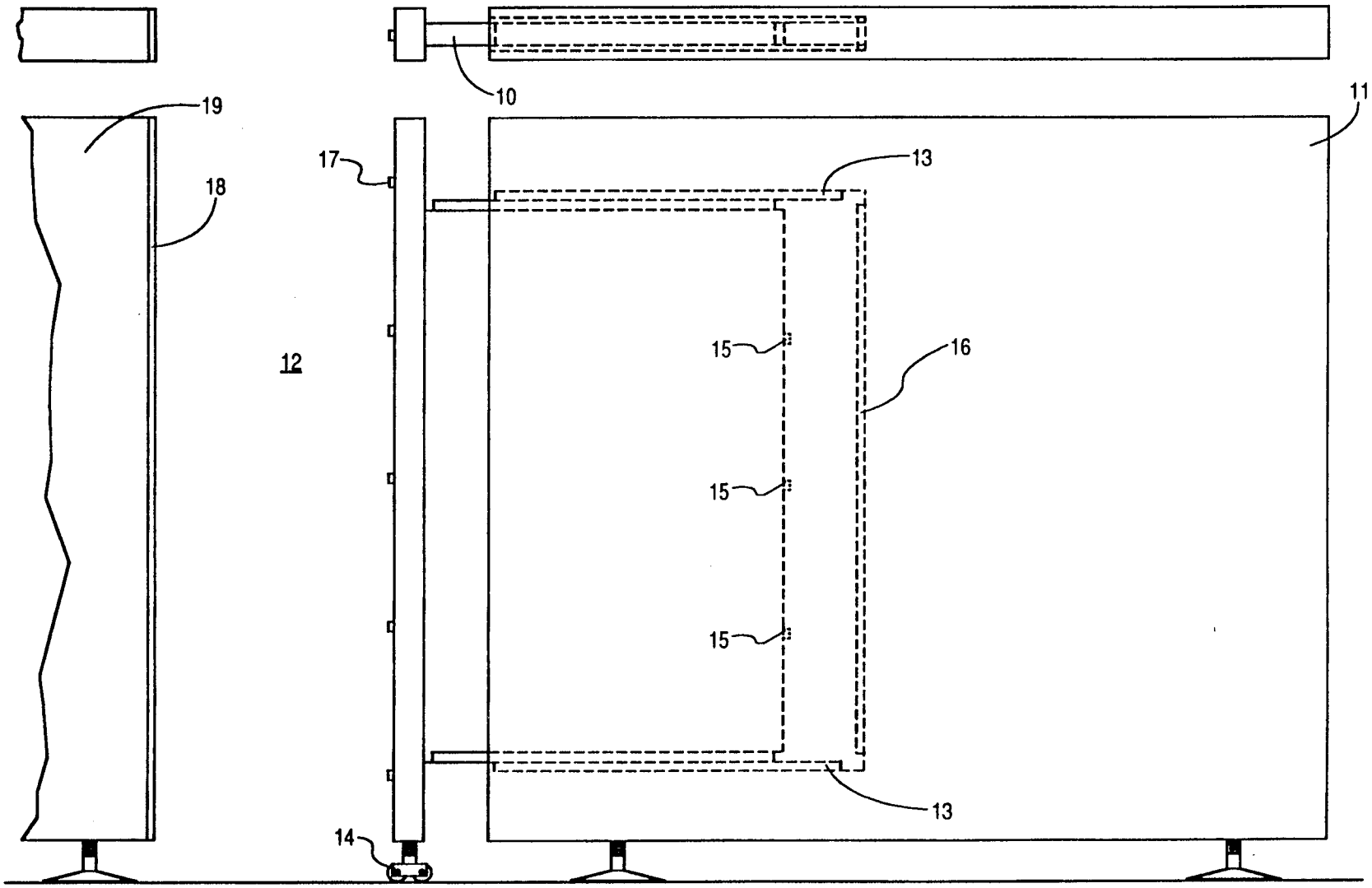
FIG. 1 shows top and side views of a privacy panel in accordance with this invention.

In FIG. 1, a privacy panel 10 is mounted within a stationary panel 11 beside an entry 12 to a work station. Privacy panel 10 is supported by a ball bearing slide 13 and by a roller foot 14, which together support panel 10 as it glides between open and closed positions. Magnets 15 make contact with a metal strip 16 to hold panel 10 in an open position, and magnets 17 contact a metal strip 18 on a stationary panel 19 across entry 12 to hold panel 10 in a closed position.

Figure 2:
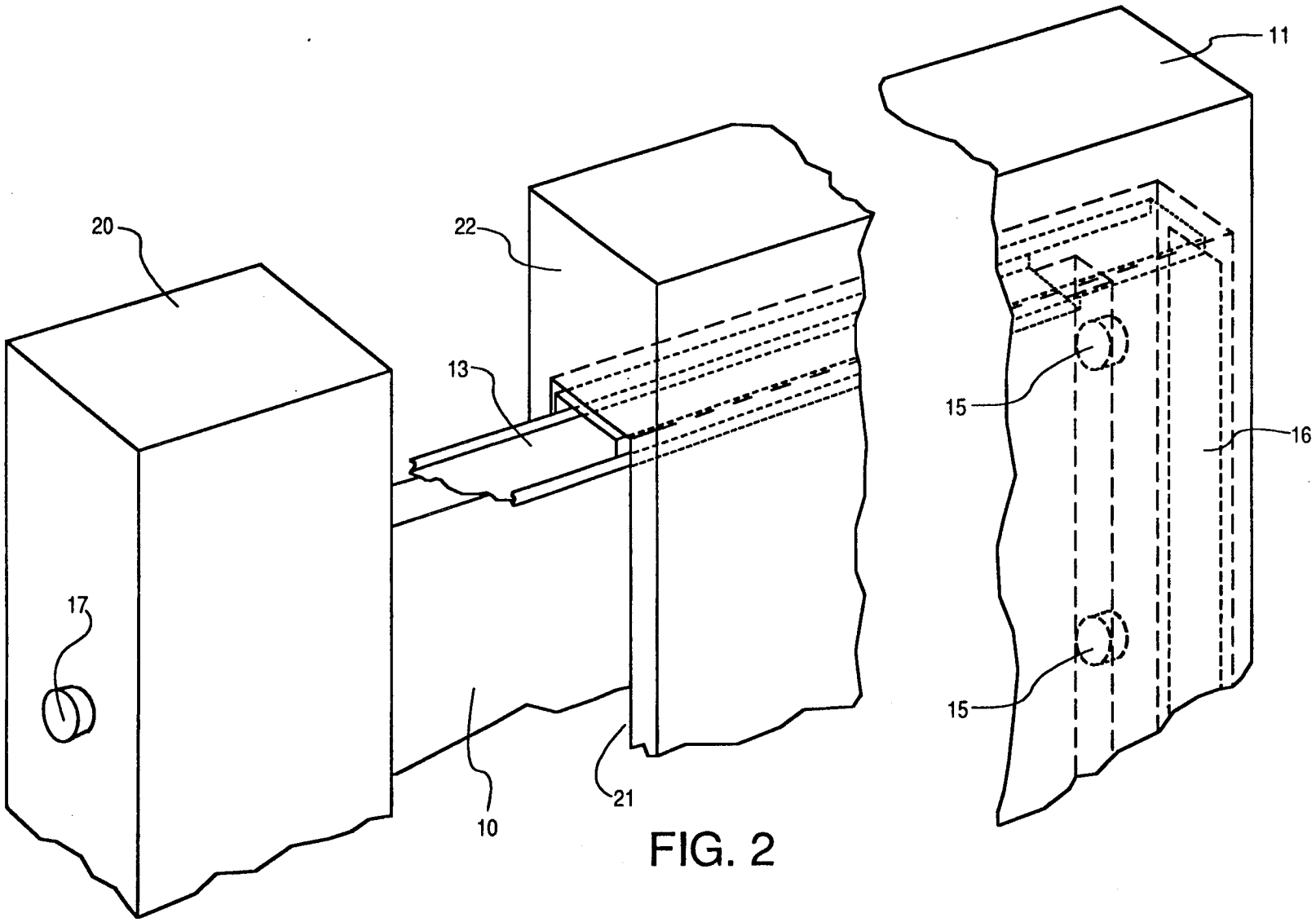
FIG. 2 detailed perspective view of a portion of a privacy panel in accordance with the invention.

FIG. 2 is a more detailed perspective view of a portion of privacy panel 10 and in particular shows a finger grip 20, which can be used to grip privacy panel 10 when opening or closing it. FIG. 2 also shows a cavity 21 which is open on a lateral edge 22 of stationary panel 11 and within which privacy panel 10 rests when it is in a open position.

Privacy panel 10 thus answers a long unfilled need for a simple, effective and inexpensive means of providing reasonable privacy to workers and others who occupy areas that are defined by modular partitions. While a major application of this invention is in the workplace, it also is usable in health care facilities, homes and other locations where partitions are found.

It will be understood that the embodiment shown in FIGS. 1 and 2 is illustrative only, and that several of the elements shown therein are optional or can be replaced by other known elements having a similar function. For example, ball bearing slide 13 can be replaced by other known mechanisms for permitting adjacent surfaces to slide or otherwise move in a direction parallel with respect to each other. Roller foot 14 may be replaced by wheels, skids or other types of moveable supports, or it may be omitted altogether if panel 10 is given sufficient support by the members which position it within panel 11. Magnets 15 and 17 may be omitted or replaced by various types of spring-loaded or other latching or retaining mechanisms. Stationary panels 11 and 19 are typically about five feet in height, but they may be either higher or lower. Moreover, stationary panel 19 may be replaced by a wall or any other physical barrier which can define one side of an entryway. In addition to the foregoing, those skilled in the art will be able to conceive of or recognize numerous alternative embodiments all of which are within the broad scope and principles of this invention.

Figure 3:
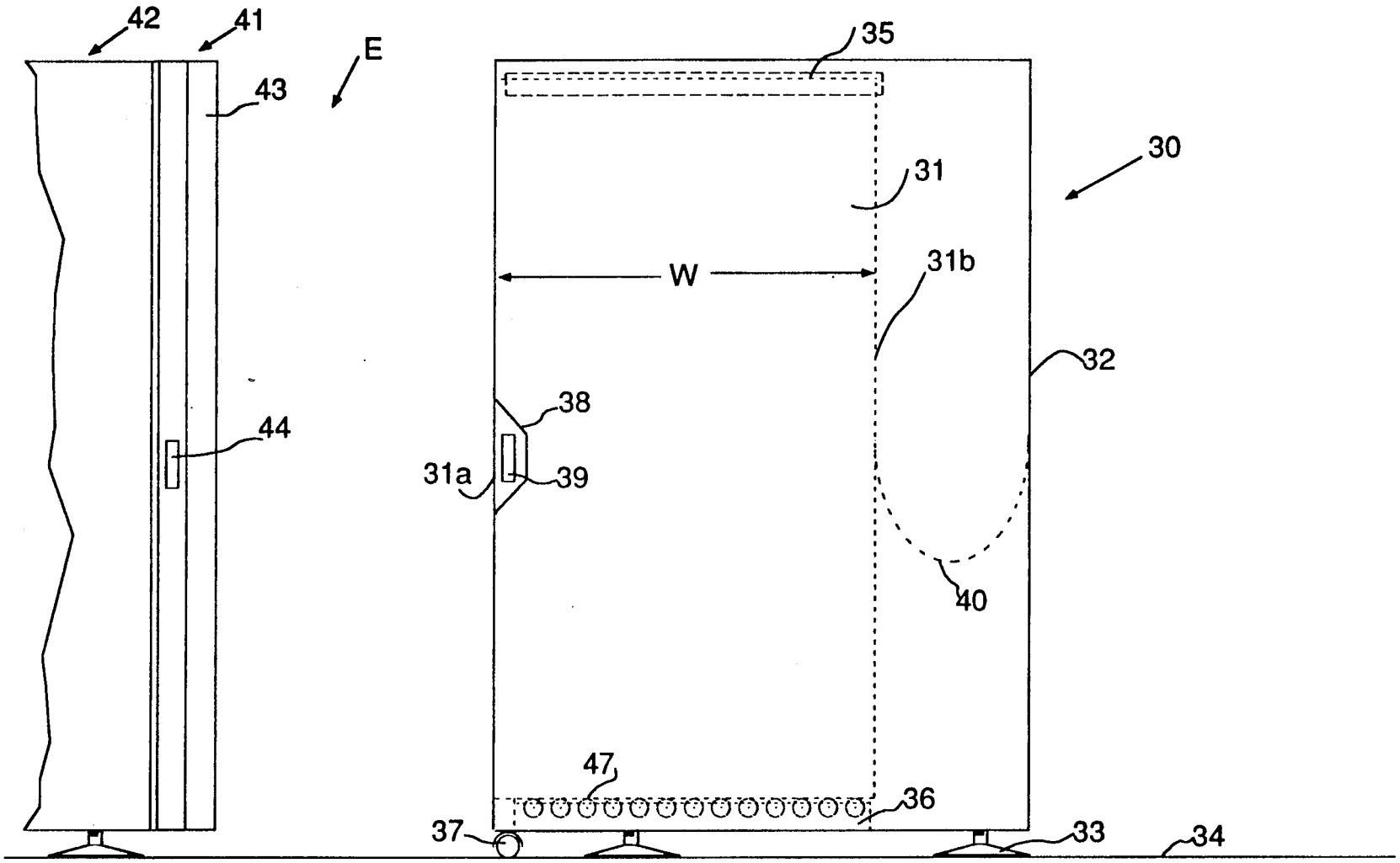
FIG. 3 is a side view of another embodiment according to invention.

FIG. 3 shows an alternative embodiment in accordance with the invention. A privacy panel unit 30 contains a privacy panel 31 with a leading edge 31*a* and a trailing edge 31*b*. A fixed edge 32 of privacy panel unit 30 is designed to be attached to existing stationary panels in an office work station or cubicle, for example. Privacy panel unit 30 has two legs 33, which rest on a floor 34. Floor 34 may or may not be carpeted.

The upper edge of privacy panel 31 slides in a channel 35, which is mounted near the top of privacy panel unit 30. The bottom edge of privacy panel 31 rests on a roller rail 36, which is mounted near the bottom of privacy panel unit 30. Leading edge 31*a* of privacy panel 31 is supported by a roller 37, which is similar to the casters used on office desk chairs, with the vertical supporting shaft fixed so that the caster may not swivel as panel 31 is opened and closed. Roller 37 is designed to roll on floor 34, without the need for any complementary structure (e.g., a track) to be mounted on or in the floor. Thus, since neither legs 33 nor roller 37 is attached to floor 34, privacy panel unit 30 is a portable, modular unit which may be installed and removed without any structural modifications to the building.

The side wall of privacy panel unit 30 is cut away in region 38 so as to expose a recessed handle 39 in privacy panel 31, thereby allowing the occupant of the work station or cubicle easily to grasp privacy panel 31 when it is in its fully open position. A cord 40 is attached to the trailing edge 32b of privacy panel 31 and to edge 32 so as to prevent privacy panel 31 from sliding completely out of privacy panel unit 30. This is particularly important during shipment of the privacy panel unit 30. At edge 32, cord 40 is inserted through a hole and knotted, thereby allowing cord 38 to be detached should privacy panel 31 need to be removed for repairs or maintenance.

On the other side of entryway E, a latch panel 41 is attached to a stationary panel 42, which is part of the existing partition structure. Latch panel 41 contains a guide 43 and latch mechanism 44, which may or may not be keyed, and which may be omitted altogether.

Figure 4:
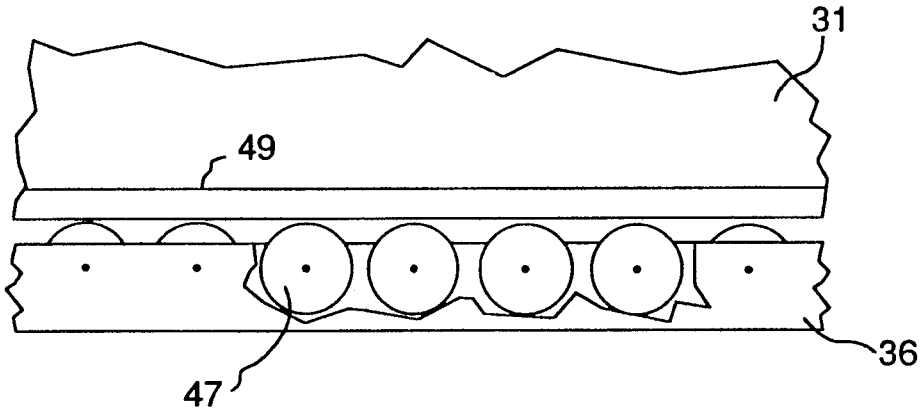
FIG. 4 is a cross-sectional view of the structures for guiding the top and bottom of the privacy panel of FIG. 3.

The details of channel 35 and roller rail 36 are shown in the cross-sectional view of FIG. 4. Channel 35 may preferably be formed of a plastic, such as high density polyethylene. Privacy panel 31 has a metal top cap 45, which slides within channel 35. It has been found that a clearance of approximately 1/16 inch between the sides of top cap 45 and the inner surfaces of channel 35 provides good stability as privacy panel 31 is withdrawn from privacy panel unit 30. Roller rail 36 comprises a metal rail 46 into which a series of plastic rollers 47 are mounted rotatably on axles 48. Privacy panel 31 has a metal bottom cap 49, which is similar to top cap 45 and rests on rollers 47. Guide bars 50 are mounted on either side of roller rail 36 to keep bottom cap 49 riding on rollers 47. A product called the Kenrail TM, manufactured by Keneco, Inc. of Kenilworth, N.J., has been found suitable for use as roller rail 36. Guide bars 50 may be made from 18 gage sheet metal and riveted to the sides of the Kenrail.

Figure 5:
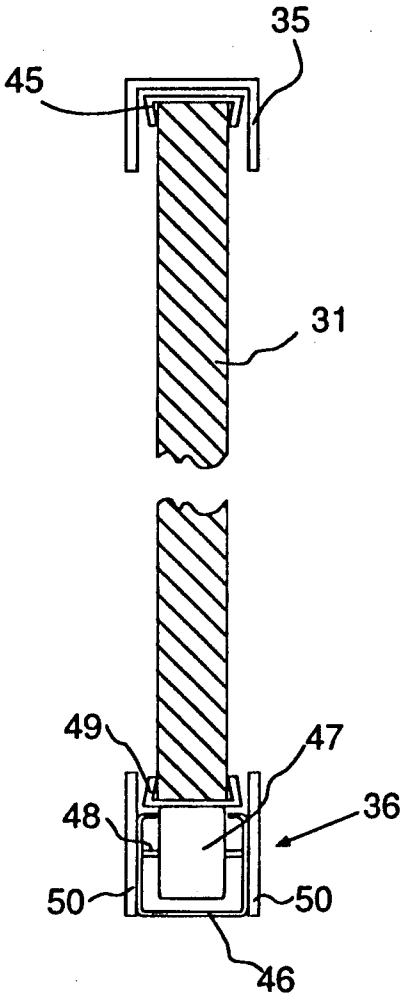
FIG. 5 is a side view of the structure for guiding the bottom of privacy panel of FIG. 3.

FIG. 5 is a side view of roller rail 36, with guide bars 50 removed, showing in detail the manner in which bottom cap 49 rides upon roller rail 36.

Figure 6:
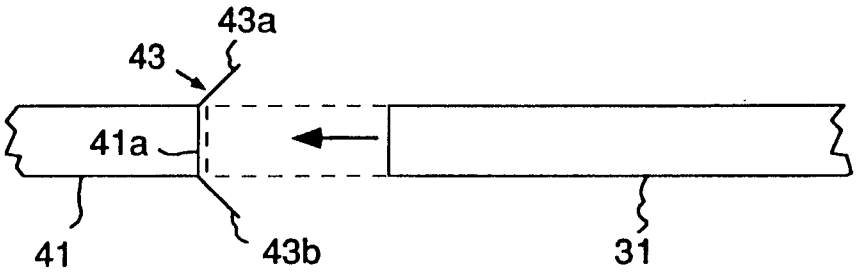
FIG. 6 a top view of the V-shaped guide for bringing the edge of a privacy panel into contact with the stationary panel on the opposite side of the entryway.

To provide good stability, the width W of privacy panel 31 should be at least 6 inches greater than the width of entryway E. Nonetheless, as privacy panel 31 is withdrawn from unit 30, the leading edge 31*a* may tend to wander slightly as a result of the inherent play in the connections with channel 35 and roller rail 36. Accordingly, it is useful to have some means of assuring that leading edge 31*a* is properly aligned when it reaches latch panel 41 on the opposite side of the entryway. Guide 43, which is illustrated in FIG. 6, performs this function. FIG. 6 is a top view of guide 43 and shows the manner in which privacy panel is guided into proper alignment as it approaches latch panel 41. Guide 43 has two outwardly extending flanges 43*a* and 43*b* shaped generally in the form of a "V", which engage panel 31 and guide it into proper alignment with a jamb 41*a* of latch panel 41, should it get slightly out of line. Thus, privacy panel 31 makes proper contact with jamb 41*a*, and the user need not be concerned about adjusting the position of privacy panel 31 in order to get secure closure or to operate latching mechanism 44. Latching mechanism 44 may be a Model 5017 Deadlock, manufactured by Adams Rite Manufacturing Co. of California, although any type of latch which provides a firm linkage between privacy panel 31 and latch panel 41 can be used. Latch mechanism 44 may or may not be keyed, as the application dictates.

Privacy panel unit 30 and latch panel 41 are modular units which may easily be conjoined with partition panels in an existing open office arrangement.

The embodiment illustrated in FIGS. 3–6 is illustrative only, and is not intended to be limiting. Many modifications of this embodiment and other embodiments in accordance with the invention will be apparent to those skilled in the art, all of which are intended to be included within the broad principles of this invention.

I claim:

1. A panel arrangement comprising:

a stationary panel having two side faces and an internal cavity, said cavity being open on a lateral edge of said stationary panel;

a physical barrier spaced from said lateral edge of said stationary panel so as to define an entryway usable by a person; and a privacy panel movably positioned in said cavity and capable of being withdrawn from said stationary panel so as to close said entryway and retracting into said stationary panel so as to open said entryway, said privacy panel being supported solely by said stationary panel to prevent said privacy panel from tilting in a direction perpendicular to the side faces of said stationary panel as said privacy panel is withdrawn from said stationary panel so as to close said entryway, said privacy panel having no structure positioned above said entryway for further supporting said privacy panel.

2. The arrangement of claim 1 wherein said privacy panel is positioned in said stationary panel by means of at least one ball bearing slide.

3. The arrangement of claim 1 comprising in addition a first holding means for holding said privacy panel so as to maintain said entryway open.

4. The arrangement of claim 3 wherein said first holding means comprises at least one magnet.

5. The arrangement of claim 1 comprising in addition a second holding means for holding said privacy panel so as to maintain said entryway closed.

6. The arrangement of claim 5 wherein said second holding means comprises at least one magnet.

7. The arrangement of claim 1 wherein said stationary panel rests on a floor, and comprising in addition at least one support means attached to said privacy panel for supporting said privacy panel on said floor as said privacy panel is being withdrawn from said stationary panel so as to close said entryway.

8. The arrangement of claim 7 wherein said support means comprises at least one roller which rolls on said floor.

9. A privacy panel unit for use in an open cubicle or work station arrangement, comprising:

a housing for a privacy panel;

a privacy panel movably positioned within the housing, the privacy panel capable of being withdrawn from the housing through an aperture at an edge of the housing;

means located inside the housing for supporting the privacy panel within the housing and for supporting and guiding the privacy panel as it is withdrawn from the housing; and means attached to the privacy panel for movably supporting the privacy panel on a floor as it is withdrawn from the housing, the means for movably supporting the privacy panel not being designed to operate in conjunction with any separate structure mounted on or in the floor;

the privacy panel having no other means of support or guidance as it is withdrawn from the housing.

10. The privacy panel unit of claim 9 wherein the privacy panel is substantially rectangular in shape, having a leading edge, a trailing edge, a top edge and a bottom edge, the means located inside the housing for supporting and guiding the privacy panel comprising a series of rollers on which the bottom edge of the privacy panel rests and a channel within which the top edge of the privacy panel is slidably disposed.

11. The privacy panel unit of claim 10 wherein the channel comprises a plastic material.

12. The privacy panel unit of claim 11 wherein the plastic material comprises high density polyethylene.

13. The privacy panel unit of claim 10 wherein the rollers are mounted on a roller rail which includes guide bars for preventing the bottom edge of the privacy panel from slipping off the rollers.

14. The privacy panel unit of claim 9 wherein the means for movably supporting the privacy panel on a floor comprises a roller.

15. A guide for use on the opposite side of an entryway from the privacy panel unit of claim 9, the guide comprising a jamb having a width substantially equal to the thickness of the privacy panel and two flanges extending outwardly from the edges of the jamb and oriented so as to guide the leading edge of the privacy panel into contact with the jamb.

16. A privacy panel unit for use in an open cubicle or work station arrangement, comprising:

a housing for a privacy panel;

a privacy panel movably positioned within the housing, the privacy panel capable of being withdrawn from the housing through an aperture at an edge of the housing; and means located inside the housing for supporting the privacy panel within the housing and for supporting and guiding the privacy panel as it is withdrawn from the housing;

the privacy panel having no other means of support as it is withdrawn from the housing.

17. The privacy panel unit of claim 16 wherein said means located inside the housing comprises a ball bearing slide.

18. The panel arrangement of claim 7 wherein no separate structure is mounted on or in said floor beneath said entryway to provide support for said privacy panel.

19. The panel arrangement of claim 1 wherein the width of said privacy panel is at least six inches greater than the width of said entryway.

20. The privacy panel unit of claim 10 comprising a means for preventing said privacy panel from becoming separated from said housing.

21. The privacy panel unit of claim 21 wherein said means for preventing comprises a cord attached between the trailing edge of said privacy panel and said housing.

22. The privacy panel unit of claim 9 wherein said privacy panel contains a latch mechanism for locking said privacy panel to an external structure when said privacy panel has been withdrawn from said housing.

23. The privacy panel unit of claim 9 wherein said housing includes a cutaway region and said privacy panel includes a recessed handle, said cutaway region being positioned such that said recessed handle is accessible to a person when said privacy panel is positioned within said housing.

24. The panel arrangement of claim 1 wherein said privacy panel includes a latch mechanism for locking said privacy panel to said physical barrier when said privacy panel is in a closed position.

25. The panel arrangement of claim 1 wherein said stationary panel includes a cutaway region and said privacy panel includes a recessed handle, said cutaway region being positioned such that said recessed handle is accessible to a person when said privacy panel is in an open position.

* * * * *